US008782833B2

(12) United States Patent
Beurguet et al.

(10) Patent No.: US 8,782,833 B2
(45) Date of Patent: Jul. 22, 2014

(54) INFLATABLE EVACUATION MATTRESS

(75) Inventors: Laurent Beurguet, Plaisir (FR); Amelie Cavillac, Plaisir (FR); Valerie Mondoly, Plaisir (FR)

(73) Assignee: Aerazur, Plaisir (FR)

( * ) Notice: Subject to any disclaimer, the term of this patent is extended or adjusted under 35 U.S.C. 154(b) by 140 days.

(21) Appl. No.: 13/471,732

(22) Filed: May 15, 2012

(65) Prior Publication Data

US 2012/0291203 A1 Nov. 22, 2012

(30) Foreign Application Priority Data

May 16, 2011 (FR) ..... 11 01493

(51) Int. Cl.
*A61G 1/013* (2006.01)
*A61G 1/044* (2006.01)

(52) U.S. Cl.
USPC ..... 5/625; 5/627; 5/628; 5/712; 128/870

(58) Field of Classification Search
USPC ..... 5/81.1 HS, 89.1, 625–628, 703, 706, 5/709–712, 722, 732; 128/870
See application file for complete search history.

(56) References Cited

U.S. PATENT DOCUMENTS 2,657,716 A * 11/1953 Ford ..... 139/410
3,775,782 A * 12/1973 Rice et al. ..... 5/625
4,254,518 A * 3/1981 Buhren et al. ..... 5/702
4,736,474 A * 4/1988 Moran et al. ..... 5/627
5,121,514 A * 6/1992 Rosane ..... 5/628
5,552,205 A 9/1996 Lea
5,701,619 A * 12/1997 Ullman ..... 5/625
6,871,368 B2 * 3/2005 Calkin ..... 5/628
7,363,668 B2 * 4/2008 Chen ..... 5/690
8,424,967 B2 * 4/2013 Kilincsoy et al. ..... 297/284.3
2003/0106155 A1 6/2003 Arai
2010/0199434 A1 * 8/2010 Keesaer et al. ..... 5/628
2010/0299837 A1 12/2010 Yandle

FOREIGN PATENT DOCUMENTS

EP 1726332 A1 11/2006

OTHER PUBLICATIONS

French Search Report dated Jan. 6, 2012.

* cited by examiner

*Primary Examiner* — Michael Trettel
(74) *Attorney, Agent, or Firm* — Bachman & LaPointe, P.C.

(57) ABSTRACT

An inflatable body includes an elongate chamber delimited by two substantially parallel main walls and defining at least a portion of a base suitable for holding a person laid down thereon, the chamber being extended, integrally, on both sides of the base, beyond a transition area where the main walls are close to each other, by two raised lateral strips extending along at least the base portion, so as to laterally flank the person, wherein the main walls are braced by a plurality of drop stitch links, and at the location of the transition area, the inflatable body has seams bringing the main walls together, thereby causing a fold between the base and each of the raised lateral strips, with the seams being covered by a sealed lining wall.

11 Claims, 3 Drawing Sheets

FIG. 1
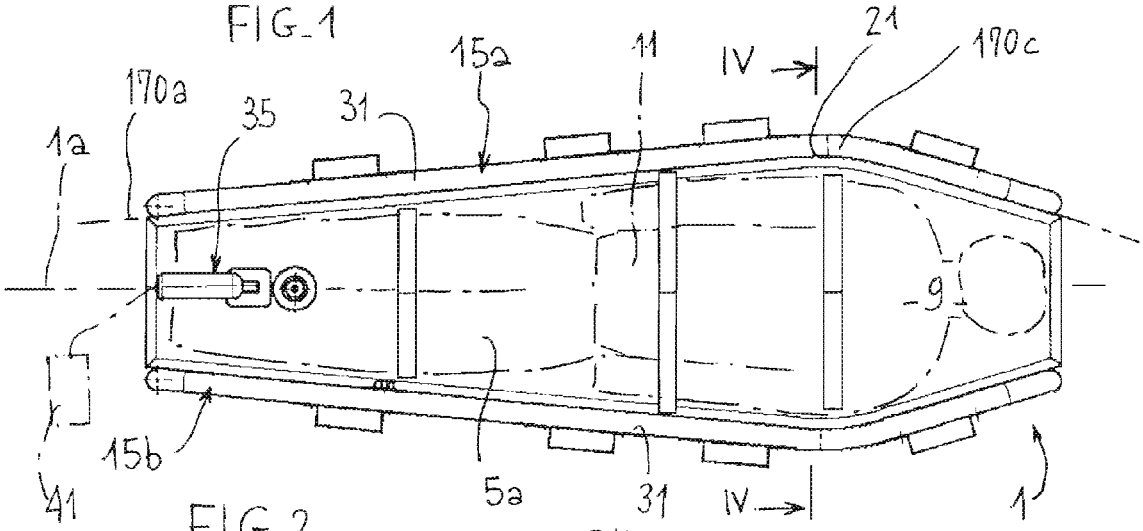
FIG. 2
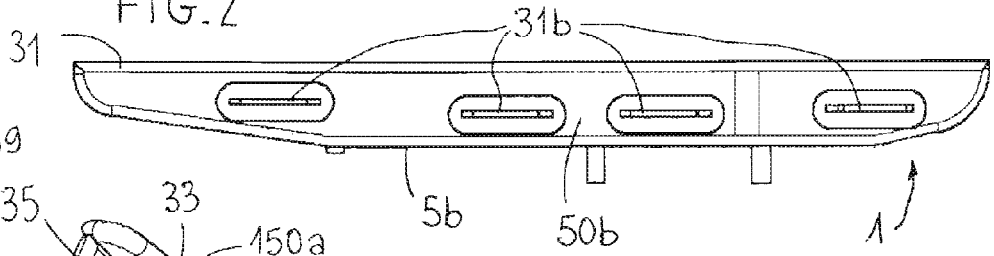
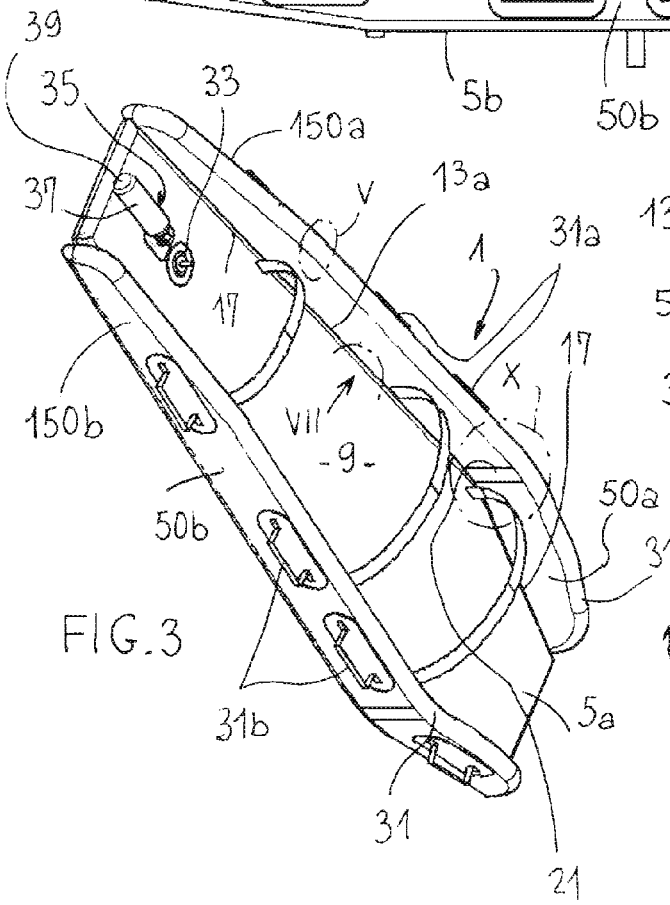
FIG. 3
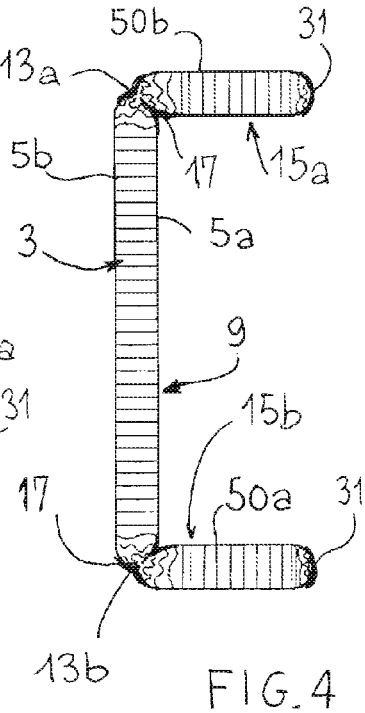
FIG. 4

FIG. 5
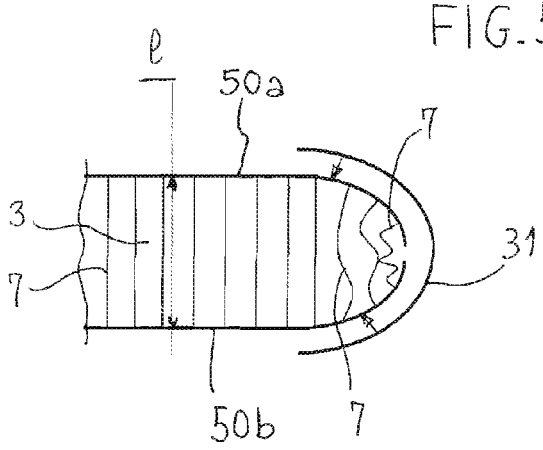
FIG. 7
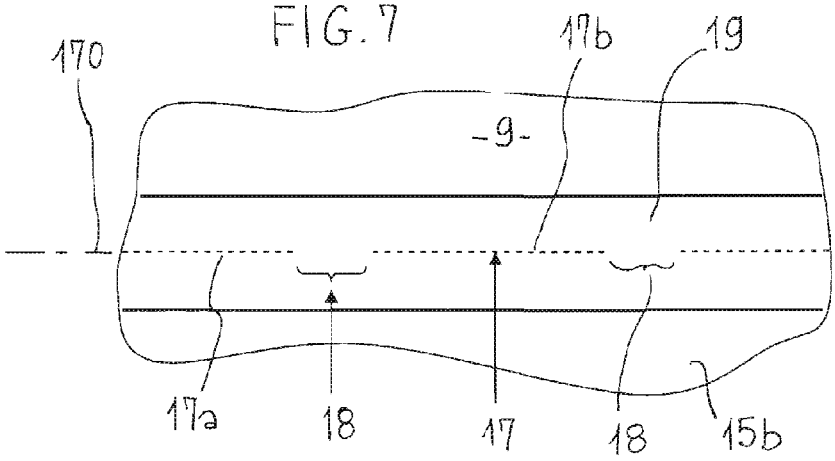
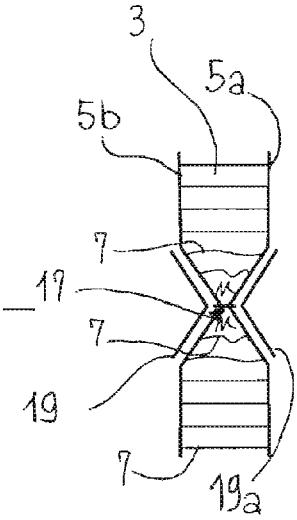
FIG. 8
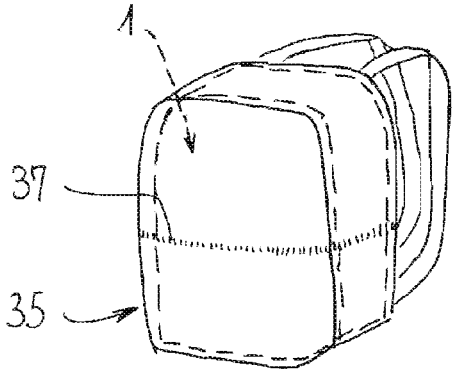
FIG. 6

INFLATABLE EVACUATION MATTRESS

BACKGROUND

The invention relates to an inflatable body for transporting people. The objective is to propose a body, also called mattress, which can be transported or carried in the arms, for evacuating wounded people.

Problems are related to the structural strength of the body, its capacity to not bend excessively under weight, while remaining lightweight enough not to affect its capacity for transporting the person, its capacity to be stowed in a small space, preferably a backpack, and to limit the risk of falling by the transported person once installed on the inflated mattress, with a planar base surface.

One solution that attempts to take into account at least some of these problems is for the inflatable body or mattress, which has a direction of elongation, to include at least one elongate chamber delimited essentially at its surface by two substantially planar main walls, approximately parallel, which are gastight, braced by a plurality of flexible links and resistant to an inflation pressure, with the chamber defining at least a portion of a base suitable for holding a person laid down in the direction of elongation, with the chamber being preferably extended, integrally, on both sides of the base, in the location of a transition area in which the two braced main walls are closer (or close to each other), by two raised lateral strips extending along the entire base or base portion, so as to laterally flank the person.

SUMMARY OF THE INVENTION

In particular, to prevent falls to the side, by more or less upright flanks, it is recommended that, in the location of the transition area, the mattress (at least in its inflated state) have at least one seam that brings the two braced main walls together, thereby causing a fold between the base and each of the raised lateral strips, with the seam being covered by a sealed lining wall.

For efficient inflation (in particular a single inflation device), resulting in increased weight gain and rigidity, it is recommended that the seams be multiple and non-continuous, thereby promoting the passage of the inflation gas between the base and each of the raised lateral strips.

The seams can define one elongated line or two parallel lines located close to each other.

In particular, to naturally raise the flanks, especially during inflation, it is recommended that each raised lateral strip have a clamp that therefore promotes the raising of said strip with respect to the base.

For ease of manufacturing compatible with mass production, and to ensure an effective seal, it is recommended that the clamp be formed by a notch produced in the lateral strip, with adjacent edges covered by a sealed lining wall.

To promote in particular the stability of the person transported and the weight increase, it is also recommended that, over the full span of the body or mattress, the base be connected to said lateral strips at the location of the transition areas along two non-rectilinear lines having at least one inflection.

To reinforce the aforementioned effects, it is also recommended that, in the location of a said inflection, the lateral strip considered have a said clamp.

Concerning the capacity of the inflated mattress not to be excessively deformed under weight, while remaining lightweight enough and easy to stow in order to be capable of being carried in a backpack, it is preferable for the entire base and the lateral strips to be integral and, when the mattress is inflated, for the pressure of each lateral strip to be at least $0.4\times10^5$ Pa, with the mechanical strength of the casing being consequently adapted, and the result obtained also using the aforementioned technique of bracing with flexible links, typically defined by a drop stitch pattern of a fabric belonging to said two sealed walls.

To promote the capacity of the mattress not to bend excessively under weight, to be stored in a small space, preferably a backpack, to be raised and moved in the arms without notably disturbing the person lying on it, while remaining lightweight enough, it is recommended that the mattress include:

along the external surface of each lateral strip, a plurality of lifting and carrying handles, a deflation opening, and a device for inflation with a gas cartridge attached to the mattress or with a valve suitable for being connected to a compressed gas supply independent of the mattress.

Preferably, to the same end, the maximum volume of the mattress to be inflated will be 120 $dm^3$.

Owing to all or some of the above features, it will preferably be possible, again in order to achieve the stated objectives, for the mattress to lack a reinforcement for the base and the lateral strips, with the inflation pressure ensuring the rigidity of the latter and the planarity of the base, when in the inflated state.

BRIEF DESCRIPTION OF THE DRAWINGS

Other features will also become apparent in reference to the appended figures, showing various embodiments, in a non-limiting manner:

FIGS. 1 to 3, views from various angles of an embodiment of the mattress, FIG. 4, a transverse cross-section view along IV-IV (the elements are seen only in the location of the cross-section, and the base is tilted vertically), FIG. 5, a transverse cross-section located in location V (FIG. 3), FIG. 6, a backpack containing a mattress, FIG. 7, a view according to VII, in the location surrounded by chain-dotted lines in FIG. 3, FIG. 8, a transverse cross-section view along VIII-VIII of FIG. 7 where is shown a seam and, in the vicinity thereof, the drop-stitch strands folded accordingly, because of their flexibility, FIG. 10, a view according to X, in the location surrounded by chain-dotted lines in FIG. 3 (the external linings 25 and 31 are shown only locally even though they longitudinally cover more extended areas), and, FIG. 9, same area, with the notch but before bringing together the lips and lining with the sealed wall bonded above.

DETAILED DESCRIPTION OF THE PREFERRED EMBODIMENT(S)

Figure 9:
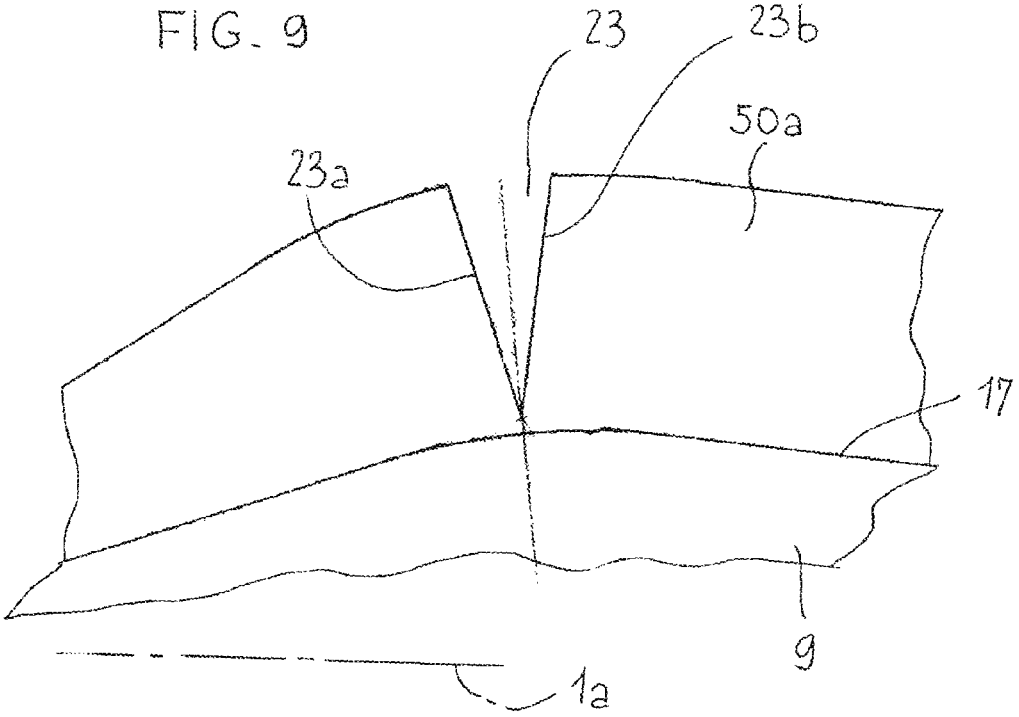

FIGS. 1 to 4 in particular show an inflatable body or mattress 1 having a direction of elongation 1*a* and including at least one elongate chamber 3 delimited essentially at its surface by two substantially planar main walls 5*a* and 5*b*. These walls are approximately parallel, gastight and braced by a plurality of flexible links 7. These links and the main walls 5*a*, 5*b* are resistant to the inflation pressure, which is therefore preferably $0.4\times10^5$ Pa. They will in principle consist of drop-stitch yarns. The fabric to which the flexible links 7 belong is lined by, or integrated with, a synthetic gastight layer so as to form two sealed walls 5*a*, 5*b*; 50*a*, 50*b*.

The chamber 3 defines at least a portion of a base 9 suitable for an adult 11 to lied, preferably the entire adult body length, along the direction of elongation 1*a*.

A uniformly flat or planar base is recommended for better effectiveness of the lateral strips 15*a*, 15*b* that thus flank its entire length.

The chamber 3 is extended, integrally, on both sides of the base 9, by two (preferably raised) lateral strips 15*a*, 15*b*, in the location of a transition area 13*a* or 13*b* where the two braced main walls 5*a*, 5*b* are closest.

Preferably, said two lateral strips 15*a*, 15*b* extend along the entire base 9 or base portion and flank the base and the lying person.

The "base portion" 9 possibility takes into account the fact that this base might be made of several areas mechanically connected to one another along the axis 1*a* (and preferably fluidly for common inflation of the entire mattress), for example, two blocks connected to one another, substantially where the pelvis of the lying person is located (see FIG. 1), by a transition area such as 13*a* or 13*b*.

In particular in order to promote a fold between the base 9 and each of the lateral strips 15*a*, 15*b*, which are preferably raised at least when the mattress is in the inflated state, it is recommended that, in the location of the (each) transition area, such as 13*a*, 13*b*, the mattress 1 have at least one seam 17 that brings the two braced main walls 5*a*, 5*b* together, thanks to the flexibility of the strands of the drop-stitch links which are folded one themselves as illustrated FIG. 8. This or these seam(s) are each, individually, preferably by seam lines, covered with a sealed lining wall 19*a*, 19*b*, for example bonded, locally above the walls 5*a*, 50*a* on one face, and 5*b*, 50*b*, on the opposite face (see FIG. 8).

Even though in the location of the (each) transition area, such as 13*a*, 13*b*, the two braced main walls 5*a*, 5*b* and/or 50*a*, 50*b* may be immediately adjacent, it is preferable for the flexible links to have a length 1 common to the location of the base, the transition areas and the two raised lateral strips. This may facilitate the manufacturing of these braced walls. The spacing between the walls 5*a*, 5*b* and/or 50*a*, 50*b* may be adapted by the seams by making them more or less compact.

As shown in FIG. 7, it is preferable for the seams 17 to be, on the same line, such as 170, (or two immediately adjacent parallel lines), multiple and discontinuous (such as 17*a*, 17*b* with discontinuities, such as 18). This will then promote, in consideration of the locations preferably provided, at least the passage of the inflation gas between the base 9 and each of the raised lateral strips 15*a*, 15*b*. Indeed, the discontinuities, or the spaces between two adjacent seams, enable the gas to circulate in the chamber 3, between the base and the lateral walls.

It may be noted that, away from the transition area(s) 13*a*, 13*b*:

at least over most of the base surface 9, the two sealed walls 5*a*, 5*b* of the base are parallel to one another (see FIG. 5), and/or the two sealed walls (in principle identical, since they are integral) 50*a*, 50*b* of the lateral walls are also parallel to one another, at least away from their outer edge where the strip 31 ensures the seal and joining of these walls 50*a*, 50*b* (see FIG. 7).

Figure 10:
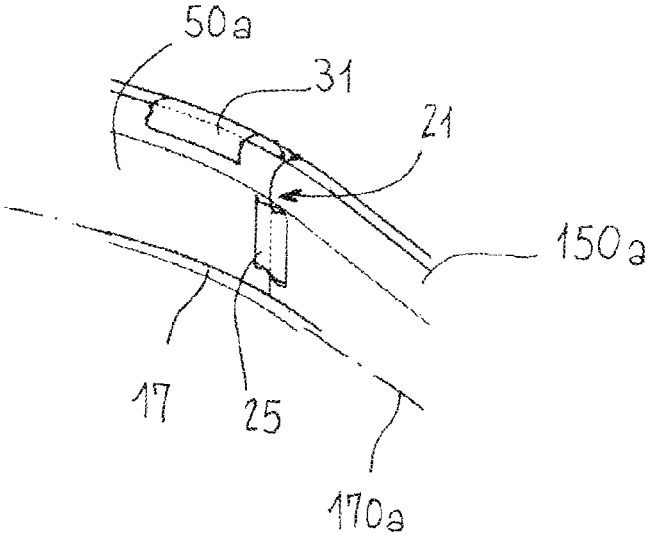

FIGS. 9 and 10 show a mattress (locally), in which, transversally to the direction of extension 1*a*, each raised lateral strip 15*a*, 15*b* has a clamp 21 that promotes a raising of said strip with respect to the base.

It is noted that, preferably, this clamp 21 will be formed by a notch 23 (FIG. 10) produced in the lateral strip considered, with its adjacent edges 23*a*, 23*b* being covered by a sealed lining wall 25 (FIG. 10).

Thus a notch 23 is shown from the lateral side of the mattress, substantially at three quarters of the overall length, according to axis 1*a* (FIG. 1).

Each notch 23 is in this case produced transversally to this axis 1*a*, on the exterior edge 150 of the raised lateral strip concerned, such as the exterior edge 150*a* for the strip 15*a*.

Such notches with adjacent edges promote the fact that, over the full span of the mattress, the base 9 may be connected to the lateral strips 15*a*, 15*b* in the location of the transition areas 17, according to two non-rectilinear lines 170*a*, 170*b* having at least one inflection, such as 170*c* for line 170*a* (FIG. 1).

It is noted, in FIG. 1, that, in the location of a said inflection, the lateral strip considered has a said clamp 21.

It is also noted, in FIG. 3, that the preferred mattress includes, attached to it, preferably on the upper face of its base 9 for a fold, facilitated maintenance and access:

along the external surface 150*a* or 150*b* of the lateral strip considered, a plurality of lifting and carrying handles, such as 31*a*, 31*b*, a deflation opening 33, and a device for inflation 35 with a gas cartridge 37 attached to the mattress or with a valve 39 suitable for being removably connected to a compressed gas supply 41 independent of the mattress (FIG. 1).

It is recommended that the handles be distributed so as to balance the carrying and promote substantially planar support of the base. The specific benefit of such multiple lifting and carrying handles (31*a*, 31*b*, . . . ) arranged along the external surface 150*a* and 150*b* of each lateral strip should thus be noted, in particular in order to facilitate the carrying and adapted support of the transported person (see FIG. 1): the lateral strips 15*a*, 15*b* indeed pivot in the location of the transition areas 17, substantially along the seam line, so that they can still stand up, in particular by being placed substantially vertically, with the base 9 remaining substantially planar.

In the figures, it may also be noted that the preferred mattress lacks a reinforcement for the base 9 and the lateral strips 15*a*, 15*b*, with the inflation pressure ensuring the rigidity thereof and the planarity of the base, in the inflated state.

FIG. 9 shows a backpack that can be opened widely, for example with a zipper closure 37, which contains the deflated and folded mattress 1.

Other inventive objects, as such, may be included in this context.

Inflatable products other than a transportable inflatable mattress may thus be considered.

An inflatable inverted V-shaped tent, in particular of which the two inclined walls have the following features, is an objective, as is a parallelepiped tent of which a plurality of sides have these features (lateral walls and/or roof, in particular).

An inflatable product including at least one elongate chamber delimited in the location of at least two adjacent parts by two substantially parallel main walls, which are gastight, braced by a plurality of flexible links (in particular drop-stitch, as mentioned above), resistant to an inflation pressure, in which the two adjacent parts are joined in the location of a transition area in which the two braced main walls are closer, wherein, in the location of the transition area, the product has at least one seam that brings the two braced main walls together and that is covered by a sealed lining wall, is thus obtained.

It is recommended:

that the seams then be non-sealed, thus promoting the passage of the inflation gas between the adjacent parts, and/or that the seams be multiple and discontinuous, and/or that the flexible links have a common length in the location of the two adjacent parts and the transition area.

The invention claimed is:

1. An inflatable body having a direction of elongation and including an elongate chamber delimited by two substantially planar main walls, approximately parallel and gastight, said chamber defining at least a portion of a base suitable for holding a person laid down in said direction of elongation, the chamber being extended, integrally, on both sides of the base, beyond a transition area where said main walls are close to each other, by two raised lateral strips extending along at least said portion of said base, so as to laterally flank the person, wherein:

said main walls are braced by a plurality of drop stitch links, and, at the location of the transition area, the inflatable body has at least one seam that brings the main walls together, thereby causing a fold between the base and each of the raised lateral strips, with each said seam being covered by a sealed lining wall.

2. The body according to claim 1, wherein there are a plurality of seams and the seams are discontinuous, thereby promoting a passage of an inflation gas between the base and each of the raised lateral strips.

3. The body according claim 1, wherein each said raised lateral strip has a clamp that promotes raising of each said strip with respect to the base.

4. The body according to claim 3, wherein the clamp is formed by a notch produced in one of the lateral strips, and adjacent edges are covered by a sealed lining and assembling wall.

5. The body according to claim 1, wherein the base is connected to said lateral strips at a location of the transition area along two non-rectilinear lines having at least one clamped inflection.

6. The body according to claim 5, wherein, at a location of said inflection, each said lateral strip has said at least one clamp inflection.

7. The body according to claim 1, wherein an entirety of the base and the lateral strips is integral, and, in an inflated state of the body, pressure in each said lateral strip is at least $0.4\times10^5$ Pa.

8. The body according to claim 1, further including along an external surface of each said lateral strip, a plurality of lifting and carrying handles; a deflation opening; and a device for inflation with a gas cartridge attached to one of the body and a valve suitable for being connected to a compressed gas supply independent of the body.

9. The body according to claim 1, wherein the body has a maximum volume to be inflated of 120 $dm^3$.

10. The body according to claim 1, wherein the body is free of any reinforcement for the base and the lateral strips, with the inflation pressure ensuring the rigidity of the lateral strips and the planarity of the base, when in the inflated state.

11. The body according to claim 1, wherein the flexible links have a common length at the location of the base, the transition areas and the two raised lateral strips.

* * * * *